United States Patent [19]

Donnelly

[11] 4,172,111

[45] Oct. 23, 1979

[54] TRIMMING OF COMPACTED METAL POWDER STRIP

[75] Inventor: Martin Donnelly, Bedford, England

[73] Assignee: Davy-Loewy Limited, England

[21] Appl. No.: 775,477

[22] Filed: Mar. 8, 1977

[30] Foreign Application Priority Data

Mar. 10, 1976 [GB] United Kingdom ..... 9528/76

[51] Int. Cl.[2] ..... B22F 3/18; B22F 3/24

[52] U.S. Cl. ..... 264/111; 75/200; 75/214; 264/37; 264/118

[58] Field of Search ..... 264/111, 118, 37, 145; 425/79, 217, 215; 75/200, 208 CS, 214

[56] References Cited

U.S. PATENT DOCUMENTS

| | | | |
|---|---|---|---|
| 2,928,133 | 3/1960 | Schairer | 264/37 |
| 3,226,765 | 1/1966 | Houser, Jr. | 264/111 |
| 3,471,602 | 10/1969 | Patton et al. | 264/111 |
| 3,892,832 | 7/1975 | Schey | 264/111 |

*Primary Examiner*—James B. Lowe

*Attorney, Agent, or Firm*—Bernard & Brown

[57] ABSTRACT

A compact in the form of a strip is manufactured from metal powder by introducing the powder into the gap between a pair of rotatable rolls. The compact so formed has unwanted longitudinally extending edge portions and these portions are removed by reducing them to powder to substantially the same particle size as that of the powder from which the compact is formed. The portions are conveniently reduced to powder by engaging them with rotary members in the form of cutters which impact the compact and break off individual particles. The powder may be recycled into the roll gap either directly or after further treatment which does not include comminution of the powder.

5 Claims, 5 Drawing Figures

TRIMMING OF COMPACTED METAL POWDER STRIP

Figure 1:
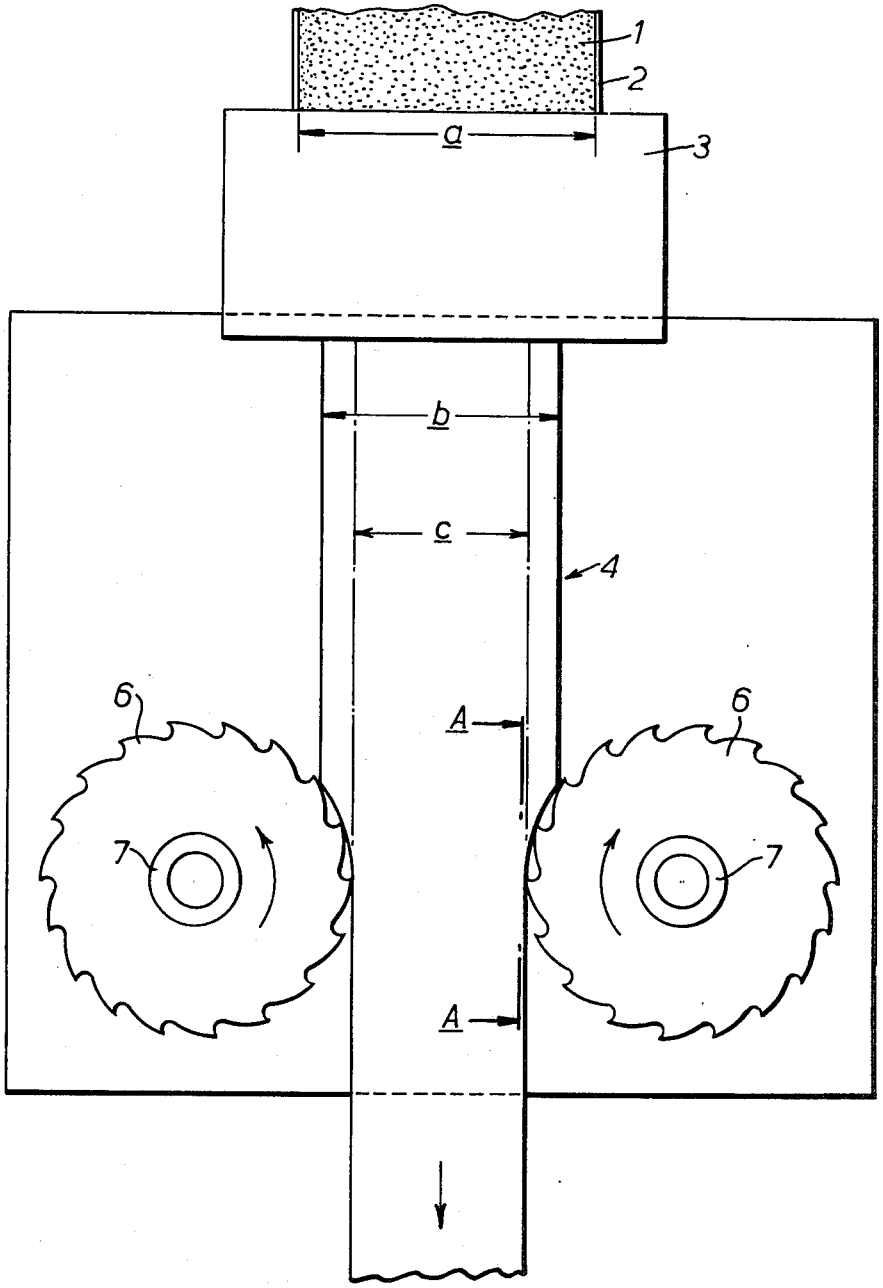

This invention relates to the manufacture of a compact in the form of a strip from metal powder.

It is known to introduce metal powder into the gap between a pair of rotating rolls to produce a compact in the form of a strip. The compact emerging from the rolls in which it is formed has a greater mass per unit area near its centre than it has near its pair of longitudinal edges. The central part of the compact has approximately uniform density but the density falls off rapidly towards the longitudinal edges of the strip. It is desirable that the compact subsequently produced has straight parallel edges and also that the strip has a fairly uniform density across its width.

It is known from British Pat. No. 1,317,441 for a compact to be trimmed along both longitudinally extending edges by cutting longitudinally extending grooves along the boundaries of the required portion of the strip on at least one face of the strip and breaking the unwanted edge portions from the required portion of the strip along the grooves. With this arrangement however the edge portions which are broken off are in fairly large fragments and if the fragments are to be comminuted into the original powder from which the compact is formed then a separate comminuting process is needed.

It is an object of the present invention to provide a method of manufacturing a compact in the form of strip from metal powder and in which material trimmed from the compact does not have to be comminuted into powder by a separate process.

According to a first aspect of the present invention in a method of manufacturing a compact in the form of a strip from metal powder, metal powder is introduced into the gap between a pair of rotating rolls to be compacted therebetween into a strip and the compact issuing from the rolls is trimmed by removing unwanted longitudinally extending edge portions thereof, said edge portions being removed by reducing them to powder of substantially the same particle size as that of the powder from which the compact is formed.

The present invention is advantageous over the known arrangement in that the compact is trimmed by having its low density longitudinal edges removed and at the same time the powder so formed can be compacted again to form a further strip with little or no further treatment.

The two longitudinally extending edge portions of the strip may be removed simultaneously.

The edge portions are conveniently reduced to powder by rotating members which engage the edge portions to impact and break off individual particles.

According to a second aspect of the invention apparatus for manufacturing a compact in the form of a strip from metal powder comprises a pair of spaced apart parallel rotatable rolls, means for introducing metal powder into the gap between the rolls and means for trimming the compact by reducing unwanted longitudinally extending edge portions thereof to powder of substantially the same particle size as that of the powder from which the compact is formed.

The trimming means may comprise a pair of rotary members in the form of cutter discs which are rotatable about axes substantially normal to the plane of the compact.

After trimming, the compact is conveniently heat treated by passing it through a sintering furnace but alternatively the compact may be passed through a furnace and then between a pair of rolls which may be heated.

Figure 2:
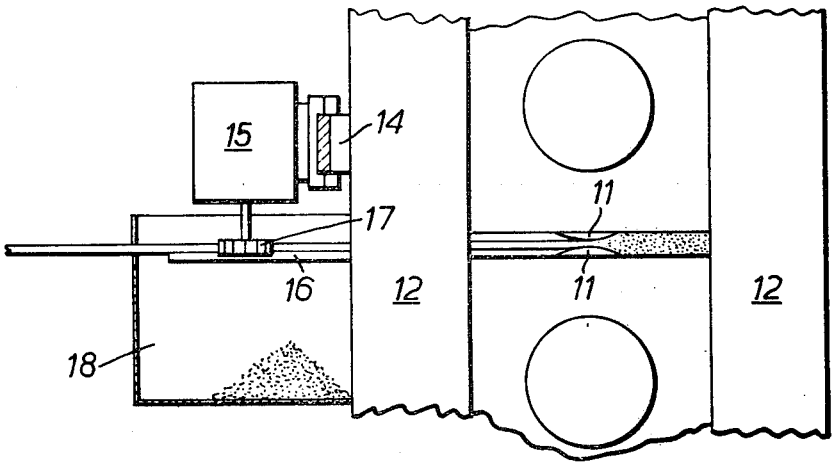
Figure 3:
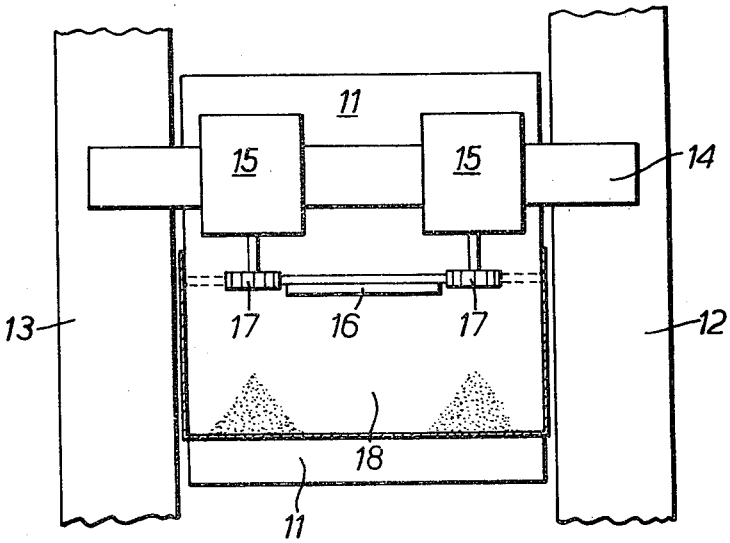
Figure 4:
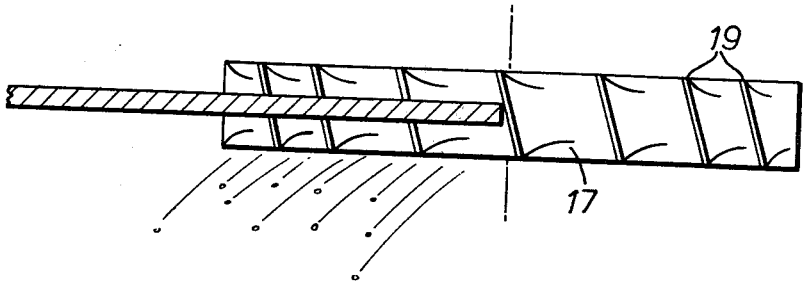
Figure 5:
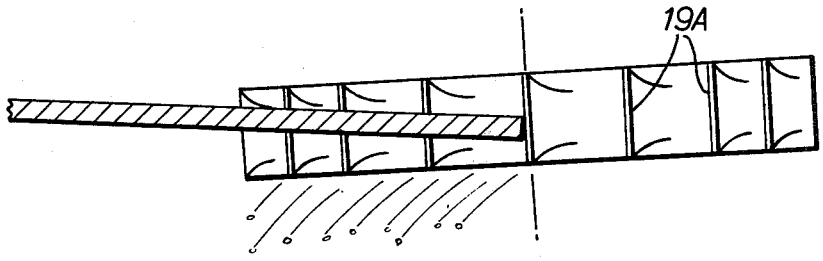

In order that the invention may be more readily understood it will now be described, by way of example only, with reference to the accompanying drawings in which:

FIG. 1 is a diagrammatic view of a powder compact apparatus taken in the direction normal to the plane of the compact, FIG. 2 is a side elevation of compact forming and trimming apparatus, FIG. 3 is an end view of the apparatus shown in FIG. 2, FIG. 4 is a view on the line A—A of FIG. 1 and FIG. 5 is a view similar to FIG. 4 but with an angled cutter.

In the manufacture of a compact in the form of a strip from metal powder, the compact being also known as a green strip, metal powder 1 is loaded into a hopper 2 from where it is fed into the gap between a pair of rotating rolls 3. Between the rolls the powder is compacted and it issues from between the rolls in the form of a compact or strip 4. If the width of the outlet of the hopper 2 is a then the width of the compact emerging from between the rolls is b, where b is slightly less than a. Over a central portion c of the compact, the density is substantially uniform but the density outside of this central portion falls off rapidly to the longitudinal edges of the strip. For the production of high quality strip it is desireable to have a minimal density variation across the width of the strip and only the central portion of the strip of width c is satisfactory for further treatment. It is desireable therefor to trim the strip along both longitudinally extending edges to remove the edge portions and produce a parallel edged strip of width c, this strip having substantially uniform density across its width.

The edge portions are removed from the central portion of the strip by comminuting the edge portions into powder of substantially the same particle size as that of the powder from which the strip is formed. A pair of milling cutters 6 are rotatable about a pair of parallel axes 7 extending normal to the plane of the strip. The thickness of the cutters is greater than the thickness of the strip and in use the cutters are rotated at such a speed that when the teeth of the cutters contact the strip the powder particles are not cut from the strip but are individually broken off by the impact of the teeth of the milling cutter.

Referring now to FIGS. 2 and 3, a powder compaction mill has a pair of rolls 11 arranged with their longitudinal axes horizontal and rotatable in a pair of housings 12, 13. A horizontal bracket 14 is secured to the housings 12, 13 on the outgoing side of the mill and the brackets support a pair of electric drive motors 15. The motors are arranged with their drive spindles extending downwardly and the motors can be moved towards and away from each other along the bracket 14 and then secured in position by means of clamps. A compact in the form of a strip produced in the mill by compacting metal powder leaves the mill supported on a horizontal table 16. The table is of a width less than that of the strip and the longitudinal edges of the strip project outwardly of the edges of the support table. Cutter discs 17 having teeth projecting from their peripheral edges are mounted one on each of the spindles of the drive motors 15 and the thickness of the discs is greater than the thickness of the strip. The cutters are positioned so that they engage the longitudinal edges of the strip and the cutters are spaced apart by an amount equal to the required useful thickness of the compact after the longitudinal edges have been removed.

The motors are energized to rotate the cutters so that the portion of the cutters engaging the strip is rotating in a direction opposite to the direction of movement of the strip. The number of teeth on each cutter and the speed of rotation of the cutters and the speed of movement of the strip are all chosen so that the cut per tooth is not greater than the diameter of the largest powder particles.

The particles removed from the strip fall into a bin 18 positioned below the support 16. The powder regenerated in this way may be recycled directly back to the hopper of the compacting mill but it may be necessary to blend it with powder which has not already been compacted and it may be necessary to provide it with a degree of annealing.

The collection of the powder may be facilitated by diverting the powder trimmed from the strip below the plane of the strip and into the bin. This may be brought about by using cutters with teeth 19 angled in a helix relative to the axis of the cutter as shown in FIG. 4. Alternatively as shown in FIG. 3, the teeth 19A on the cutter may be straight but the axis of rotation of the cutter may be slightly inclined to the plane of the strip so that the particles trimmed from the strip are directed downwardly below the level of the strip and into the bin.

A particular example of the operation of the apparatus shown in FIGS. 2 and 3 is as follows. Assuming that the strip compact has been formed from powder which has been sieved through a sixty mesh screen, then the strip will contain particles of up to 0.25 mm sieve size. To ensure that particles which are not greater than this size are removed from the compact, the cut per tooth should not be greater than 0.25 mm. The drive motors 15 are thus rotated at 1200 r.p.m. and the strip is produced at 100 mm per second. The strip is thus fed into the cutter at 5 mm per revolution and if there are twenty teeth on the cutter the feed will be 0.25 mm per tooth.

The diameter of the cutter should be at least twice the depth of the cut and in practice a 75 mm diameter cutter having twenty four teeth may be used to trim 11 mm off of strip made from sixty mesh powder at 100 mm per second.

What I claim as my invention and desire to secure by Letters Patent of the United States is:

1. A process for manufacturing a compact in the form of a strip from metal powder comprising:

(a) introducing a metal powder of a predetermined particle size into a gap between a pair of rotating rolls to be compacted therebetween into a compact in the form of a strip having at least one longitudinally extending edge portion;

(b) delivering at a predetermined rate said compact from said rolls to a station for trimming said compact along said longitudinally extending edge portion; and (c) said trimming including continuously impacting the edge portion with impact members on a rotating device at predetermined intervals, said trimming step being coordinated with said delivery step to maintain a cut per impact member no greater than said predetermined particle size, to remove at each impact a particle of a thickness no greater than said predetermined particle size such that the powder removed from said strip is of no greater size than that of the powder from which the compact is formed.

2. The process according to claim 1 wherein said trimming step includes rotating a disc having a plurality of cutters extending therefrom in the direction opposite to the direction of movement of said compact.

3. A process for manufacturing a compact in the form of a strip from metal powder comprising:

(a) introducing a metal powder of a predetermined particle size into a gap between a pair of rotating rolls to be compacted therebetween into a compact in the form of a green strip having at least two parallel longitudinally extending edge portions;

(b) delivering at a predetermined rate said compact from said rolls to a station for trimming said compact simultaneously along each of said two edge portions;

(c) said trimming including continuously impacting each of said edge portions by rotating a disc a plurality of cutter teeth extending therefrom in a direction opposite to the direction of movement of said compact; and (d) rotating said cutter teeth to cut said edge portions at predetermined intervals, said rotating step being coordinated with said delivering step to maintain a cut per tooth of said cutter teeth no greater than said predetermined particle size, to remove at each impact a particle of a thickness no greater than said predetermined particle size such that the powder removed from said strip is of no greater size than that of the powder from which the compact is formed.

4. A process as claimed in claim 3 wherein teeth on the cutter discs are inclined other than at 90° to the horizontal so that the particles removed from the compact are directed downwardly below the horizontal.

5. A process as claimed in claim 2 wherein the compact is supported on a horizontal surface with its edges projecting outwardly from the edges of the surface.

* * * * *

UNITED STATES PATENT AND TRADEMARK OFFICE

CERTIFICATE OF CORRECTION

PATENT NO. : 4,172,111

DATED : October 23, 1979

INVENTOR(S) : Martin Donnelly

It is certified that error appears in the above—identified patent and that said Letters Patent is hereby corrected as shown below:

In Claim 1, column 4, line 11, after "with said","delivery" should read --delivering--.

In Claim 3, column 4, line 35, after "a disc" and before "a plurality" insert --having--.

Signed and Sealed this

*Fifth* Day of *August 1980*

[SEAL]

*Attest:*

SIDNEY A. DIAMOND

*Attesting Officer*

*Commissioner of Patents and Trademarks*